United States Patent [19]

Froment

[11] 4,377,799

[45] Mar. 22, 1983

[54] CONTROL UNIT COMPRISING ELECTROMAGNETS, PARTICULARLY FOR ACTUATING DOBBIES FOR WEAVING MACHINES

[75] Inventor: Jean-Paul Froment, Doussard, France

[73] Assignee: S.A. des Etablissements Staubli, Faverges, France

[21] Appl. No.: 257,034

[22] Filed: Apr. 24, 1981

[30] Foreign Application Priority Data

May 6, 1980 [FR] France ..... 80 10548

[51] Int. Cl.[3] ..... H01F 7/08

[52] U.S. Cl. ..... 335/266; 335/256; 335/181

[58] Field of Search ..... 335/266, 267, 268, 246, 335/256, 149, 136, 256, 177, 180, 181

[56] References Cited

U.S. PATENT DOCUMENTS 3,763,448 10/1973 Walters ..... 335/266

*Primary Examiner*—Harold Broome

*Attorney, Agent, or Firm*—Dowell & Dowell

[57] ABSTRACT

The present invention relates to a control unit comprising a series of electromagnets for actuating juxtaposed or superposed mobile armature members. A cover locked in an frame contains a series of cores maintained in position by abutment of coil supports and by a plate. The latter supports a printed circuit connected to the coils and to a cable. The frame cover assembly is filled with a mass of injected resin. The invention is particularly applicable to textile equipment (dobbies).

3 Claims, 2 Drawing Figures

CONTROL UNIT COMPRISING ELECTROMAGNETS, PARTICULARLY FOR ACTUATING DOBBIES FOR WEAVING MACHINES

The present invention relates to a control device comprising a series of electromagnets intended for selectively actuating a corresponding number of mobile armature members which are superposed or juxtaposed at a regular interval, and in particular elements of a dobby for a weaving machine.

It is a more particular purpose of the invention to provide a control unit of the above-mentioned type which is of simple and robust construction and in which the actuating electromagnets may be provided at a much reduced spacing, whilst being adapted to supply maximum power.

The unit according to the invention is mainly noteworthy in that it comprises in combination an frame with U-shaped cross section, a protective cover fixed by its open base in the frame and provided with two parallel series of openings cut out therein, corresponding to the section of the poles of the electromagnets, a plurality of cores in number equal to that of the openings of each series, coils advantageously mounted alternately on one or the other of the arms of the cores and of which the support with lateral cheeks bears against the inner face of the cover and against the bottom of the core envisaged, a positioning plate which closes the base of this cover and which presents a row of windows for centering bosses provided on the cores, a printed circuit associated with a supply cable and held against the inner face of the positioning plate, and a coating mass composed of synthetic resin, injected so as completely to fill the free inner space of the frame and of the cover.

The frame, preferably made of aluminium in order to be highly rigid whilst ensuring good heat conduction for evacuation of the heat, is sectioned along the arms of its U-shaped cross section for the cover, provided with longitudinal bosses, to be fixed to said frame by simple locking action.

The invention will be more readily understood on reading the following description with reference to the accompanying drawings, in which.

Figure 2:
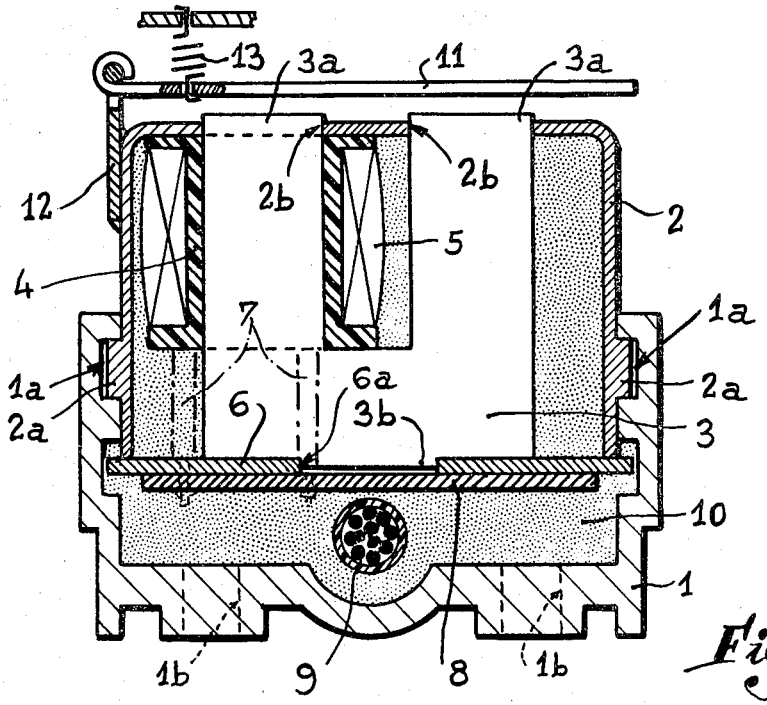
FIG. 2 is a schematic transverse section along the plane indicated at II—II of FIG. 1 showing an armature above one of the electromagnets.

Referring now to the drawings, reference 1 denotes a metal frame made of aluminium or cast aluminium alloy, of which the length is equal to that of the control unit to be made and therefore depends on the number of electromagnets thereof. As shown in FIG. 2, the cross section of this frame 1 is in the form of a U, the inner face of each arm being recessed with a longitudinal depression 1*a*. The transverse edges of the bottom of the frame 1 are arranged to allow the whole of the control unit to be easily fixed; in the embodiment envisaged, it has been assumed that these edges were pierced with holes 1*b* for the passage of screws or bolts. It should further be observed that the frame 1 is provided with reinforcing ribs which improve its rigidity and which determine aeration channels facilitating evacuation of the heat into the ambient air. Each electromagnet 3 has an armature 11 pivoted to the frame 2 by a bracket 12 and is urged toward an open position by a spring 13. This construction is functionally similar to the actuators shown in U.S. Pat. Nos. 1,767,058 to Eiseman and 2,611,012 to Baker and 2,635,138 to Reisner Jr., although the structures of the various electromagnets are quite different.

In the frame 1 is engaged the open base of a cover 2, also made of aluminium or a light alloy based on aluminium. Each of the lateral walls of this cover 2 presents an outer boss 2*a* which extends longitudinally and locks, with momentary elastic deformation, in the corresponding depression 1*a* in the frame 1. Furthermore, the bottom of the cover 2 is provided with two parallel rows of openings 2*b*, made in the form of a flattened rectangle oriented transversely with respect to the axis of the cover; in each pair of transversely aligned openings 2*b* are introduced the ends, forming poles 3*a*, of the two arms of a soft iron core 3 of conventional U-section.

On one of the arms of each core 3 is engaged the tubular support 4 of a coil 5; the lateral cheeks of this support 4 abut against the bottom of the core 3 and against the inner face of the cover 2, thus opposing the displacement of said core towards the outside, whilst its inward displacement is limited by bearing against a positioning plate 6. The latter is fixed against the edges of the cover 2 and it extends over the whole length of the base thereof; it will be noted that this plate 6 is provided with a series of central windows 6*a* of transversely elongated rectangular section, in each of which is housed a boss 3*b* made on each of the cores 3.

Figure 1:
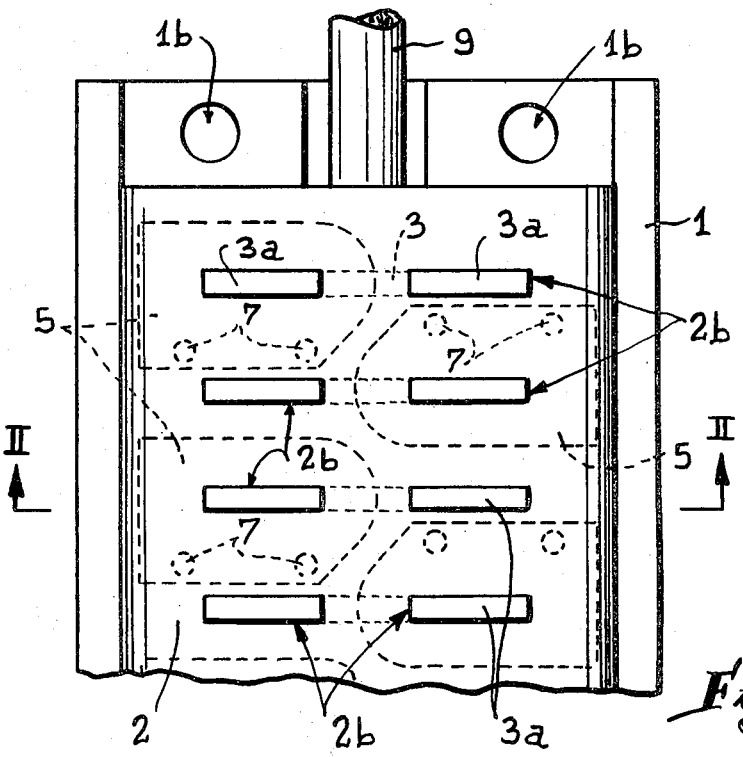
FIG. 1 is a partial plan view showing a control unit with electromagnets according to the invention.

It will be noted that, in order to limit to the strict minimum the reciprocal spacing of the cores 3 despite the excess thickness formed by the coils 5, the latter and their supports 4 are disposed alternately on the cores, as clearly shown by broken lines in FIG. 1. Each coil 5 is connected by connections 7 to a printed circuit 8 applied against the lower face of the positioning plate 6; this circuit 8 is itself electrically connected to a common supply cable 9 housed between said circuit and the bottom of the frame 1. The fixing of the printed circuit 8 against the plate 6 and of the latter against the open base of the cover 2 is advantageously ensured by pins 7 of which the projecting ends are welded against said circuit after having passed therethrough and through the plate. In any case, once the different elements of the unit are introduced and mounted in the body constituted by the frame 1 and the cover 2, the free inner space of said body is filled with a mass 10 of synthetic resin injected through appropriate openings, said mass 10 entirely filling all the spaces between the cores 3, coils 5, plate 6, cable 9, etc.

A compact unit is therefore finally obtained, which is perfectly rigid whilst being capable of evacuating, particularly efficiently, the heat emitted by intensive functioning of the coils 5. Before the mass of coating matter 10 is injected, the constituent elements are positioned precisely, so that the filling operation cannot disturb the construction. It will be noted that the invention makes it possible to produce a unit of one-piece electromagnets, which are independent and tight, connected to an electronic control panel by a single cable, so that, in case of breakdown, it suffices to disconnect this cable to take out the device and replace it. Maintenance of the equipment is thus considerably simplified.

The foregoing description has, of course, been given solely by way of example and in no way limits the field of the invention. Equivalent elements may be substituted without departing from the scope thereof. It is obvious that the electromagnets may be in any number.

What is claimed is:

1. An electromagnetic control unit for actuating mobile armature members to control a dobby for a weaving machine, the control unit comprising:

an elongated frame of U-shaped cross section;

a hollow cover for the frame, the cover having a face having two parallel series of paired core-receiving holes therethrough, and having an open base shaped to be received in the U-shaped frame and enclose it;

multiple cores, each having two arms extending outwardly through adjacent holes of the two series and having between the two arms a centering boss;

a positioning plate lying across the open base of the cover and having a series of windows each receiving the centering boss of a core;

a coil surrounding one arm of each core and having connections to its winding, the coils lying between the cover face and the positioning plate;

a printed circuit board adjacent to the positioning plate and connected to the connections of the coils;

a cable coupled to the connections of the circuit board and extending from the frame; and a synthetic resin filling the free space in the frame and the cover.

2. A control unit as claimed in claim 1, wherein the coils are supported on different arms of the cores and are located alternately opposite the core-receiving hole of a different series.

3. A control unit as claimed in claim 1, wherein the U-shaped frame has legs receiving the open base of the cover, and the base of the cover and the receiving legs of the frame are shaped to interlock when pressed together.

* * * * *